US008960479B2

(12) United States Patent
Meers et al.

(10) Patent No.: US 8,960,479 B2
(45) Date of Patent: Feb. 24, 2015

(54) STACKABLE LOW DEPTH TRAY

(71) Applicant: Rehrig Pacific Company, Los Angeles, CA (US)

(72) Inventors: Ryan C. Meers, West Chester, PA (US); William P. Apps, Alpharetta, GA (US); Suzanne Whitfield Clark, Atlanta, GA (US)

(73) Assignee: Reehrig Pacific Company, Los Angeles, CA (US)

( * ) Notice: Subject to any disclaimer, the term of this patent is extended or adjusted under 35 U.S.C. 154(b) by 0 days.

(21) Appl. No.: 14/054,025

(22) Filed: Oct. 15, 2013

(65) Prior Publication Data

US 2014/0102933 A1 Apr. 17, 2014

Related U.S. Application Data

(60) Provisional application No. 61/714,090, filed on Oct. 15, 2012.

(51) Int. Cl.
*B65D 1/24* (2006.01)
*B65D 21/02* (2006.01)

(52) U.S. Cl.
CPC ..... *B65D 21/0212* (2013.01); *B65D 1/243* (2013.01); *B65D 2501/24019* (2013.01); *B65D 2501/2407* (2013.01); *B65D 2501/24108* (2013.01); *B65D 2501/24152* (2013.01); *B65D 2501/24267* (2013.01); *B65D 2501/2435* (2013.01); *B65D 2501/24687* (2013.01); *B65D 2501/24878* (2013.01); *B65D 2501/24133* (2013.01); *B65D 2501/2428* (2013.01); *B65D 2501/24522* (2013.01)
USPC ..... 220/516; 220/509; 220/4.27; 206/505

(58) Field of Classification Search
CPC ..... B65D 1/0215; B65D 81/3846; B65D 81/3837; B65D 13/02; B65D 2501/24019; B65D 2501/2407; B65D 2501/24108; B65D 2501/24152; B65D 2501/24267; B65D 2501/2435; B65D 2501/24687; B65D 2501/24878; B65D 2501/24133
USPC ..... 220/DIG. 2, DIG. 15, 669, 676, 507, 220/509, 516, 4.27, 4.26, 23.83; 206/512, 206/518, 519, 520, 775, 507, 505, 503
See application file for complete search history.

(56) References Cited

U.S. PATENT DOCUMENTS

| | | | |
|---|---|---|---|
| D378,249 | S | 3/1997 | Apps et al. |
| 5,720,688 | A | 2/1998 | Wilson et al. |
| D398,152 | S | 9/1998 | Kelly |
| 5,979,654 | A | 11/1999 | Apps et al. |
| 7,036,666 | B2 | 5/2006 | Hammett |

(Continued)

*Primary Examiner* — Robert J Hicks
*Assistant Examiner* — Kareen Rush
(74) *Attorney, Agent, or Firm* — Carlson, Gaskey & Olds

(57) ABSTRACT

A crate includes a base, a pair of opposed end walls extending upward from the base, and a pair of opposed side walls extending upward from the base between the end walls. Each side wall includes a plurality of side columns extending upward from the base to a side band. Each side band includes a logo portion having a protruding portion protruding upward relative to an upper edge of the side band. Each side band further includes a curved recess formed in a lower edge of the side band, the curved recess complementary to the protruding portion of the logo portion. The protruding portions of the logo portions are offset in opposite directions from a center of the side walls.

12 Claims, 13 Drawing Sheets

(56) References Cited

U.S. PATENT DOCUMENTS

| | | | | |
|---|---|---|---|---|
| 7,086,531 | B2 | 8/2006 | Apps et al. | |
| 7,207,458 | B1 | 4/2007 | Koefelda et al. | |
| 7,281,641 | B2 | 10/2007 | Apps | |
| 8,186,534 | B2 * | 5/2012 | Apps | 220/515 |
| 8,517,203 | B2 * | 8/2013 | Apps | 220/515 |
| 8,672,161 | B2 | 3/2014 | Apps | |
| 8,757,420 | B2 | 6/2014 | Stahl | |
| 2003/0075546 | A1 | 4/2003 | Hammett | |
| 2008/0083638 | A1 * | 4/2008 | Meers | 206/505 |
| 2010/0170823 | A1 | 7/2010 | Koefelda et al. | |
| 2014/0110303 | A1 | 4/2014 | Meers et al. | |

* cited by examiner

STACKABLE LOW DEPTH TRAY

BACKGROUND

Injection-molded plastic beverage crates are used to ship beverage containers, such as plastic bottles, to stores. Often, it is intended that consumers will view the bottles in the store to make their selection and then remove the desired bottles from the crate.

Many known crates includes a base, a pair of opposed end walls extending upward from the base, and a pair of opposed side walls extending upward from the base between the end walls. Each side wall includes a plurality of side columns extending upward from the base to a side band.

SUMMARY

The present invention relates to crates for carrying bottles, particularly plastic beverage bottles. One example for multi-serving (e.g. 2 liter) bottles is disclosed. One example for single serving (e.g. 20 oz or half-liter) bottles is disclosed. The crates are preferably injection molded as a single piece of plastic, such as HDPE or other suitable material.

The crate includes a base, a pair of opposed end walls extending upward from the base, and a pair of opposed side walls extending upward from the base between the end walls. Each side wall includes a plurality of side columns extending upward from the base to a side band.

Each side band includes a logo portion having a protruding portion protruding upward relative to an upper edge of the side band. Each side band further includes a curved recess formed in a lower edge of the side band, the curved recess complementary to the protruding portion of the logo portion. The protruding portions of the logo portions may be offset in opposite directions from a center of the side walls.

In the disclosed embodiments, the logo portions are ellipses having its major axis at an acute, non-zero angle relative to the straight upper edge of the side band. Each ellipse is truncated by the curved recess. Each ellipse may also be truncated by the straight lower edge of the side band.

The logo portions provide increased brand association with the product being sold from the crate. The logo portions also provide an anti-theft feature in that the crate will not provide a stable surface if inverted.

DETAILED DESCRIPTION OF THE PREFERRED EMBODIMENT

Figure 1:
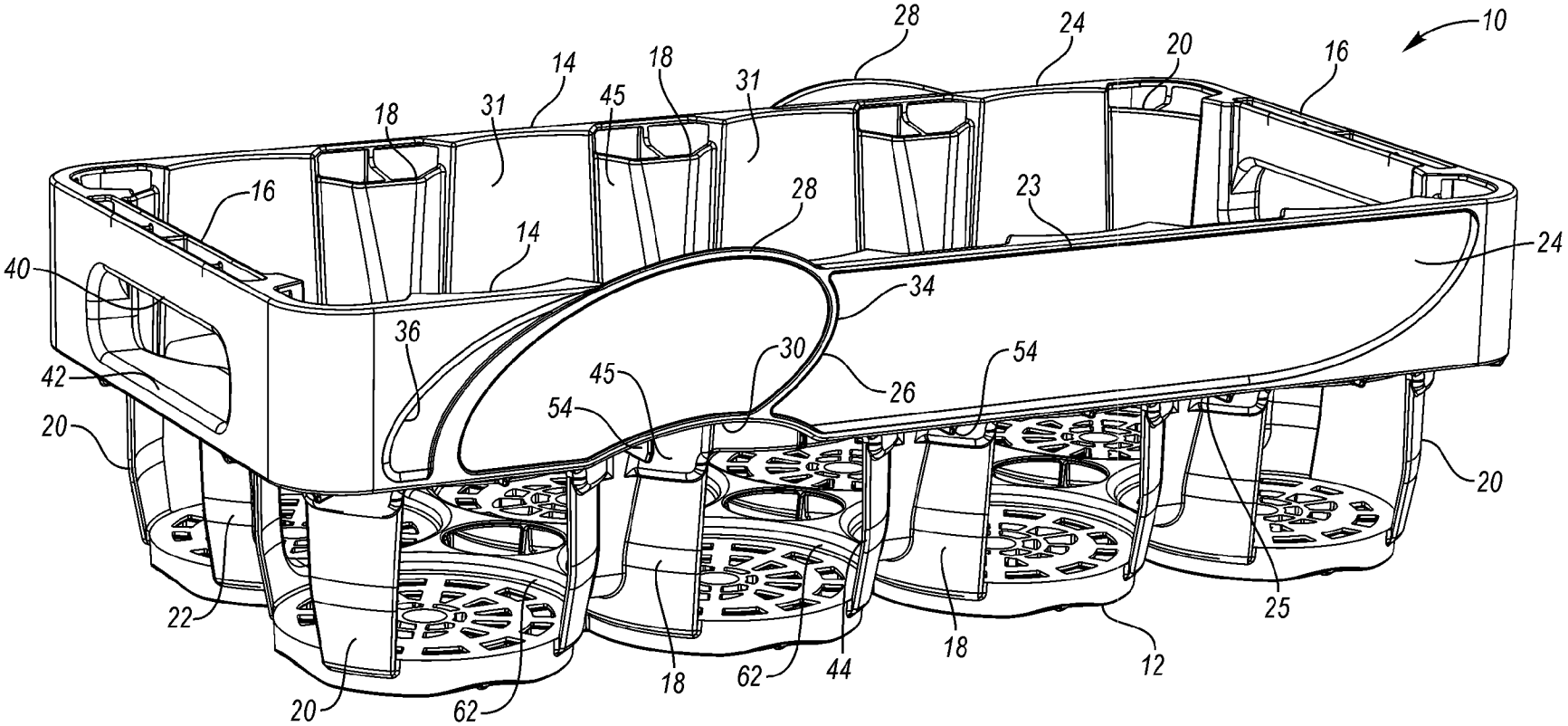
FIG. 1 is a perspective view of a crate according to one embodiment of the present invention.

A crate 10 according to one embodiment of the present invention is shown in FIGS. 1-8 and is particularly suited for multi-serving bottles. The crate 10 includes a base 12 including a plurality of circular platforms each defining a bottle support surface. A pair of side walls 14 extend upward from side edges of the base 12. End walls 16 extend upward from end edges of the base 12. Each side wall 14 includes a plurality of side columns 18 extending upward from the base 12. Corner columns 20 extend upward from corners of the base, while end columns 22 extend upward from ends of the base 12.

Each side wall 14 includes a side band 24 spaced upwardly from the base 12 and positioned along the outside of the side columns 18. The side band 24 generally includes a straight upper edge 23 and a straight lower edge 25, but also includes a logo portion 26, which in this embodiment is in the form of an ellipse or oval 26 whose major axis is at an acute, non-zero angle relative to the straight upper edge 23. The logo portion 26 is superimposed over the straight upper edge 23 of the side band 24 and includes a curved protruding portion 28 that protrudes upward relative to the otherwise straight upper edge 23 of the side band 24. At a lower end, the logo portion 26 is truncated by the straight lower edge 25 and a curved cutout 30 in the otherwise straight lower edge 25 of the side band 24. The logo portion 26 is completely circumscribed by a rib 34. The side band 24 further includes a recessed arcuate portion 36 adjacent the logo portion 26. Between the columns 18, the side wall 14 includes a concave interior wall 31, spaced inward from the side band 24.

The logo portions 26 on the two side bands 24 are off-center and are on opposite ends of the centerline. This arrangement of the curved protruding portions 28 provides a relatively unstable surface for the crate 10 if the crate 10 were flipped over. This discourages theft of the crate 10, because it cannot be used as a stool, step or other support surface.

Each end wall 16 includes an upper handle portion 40 and a lower handle portion 42 extending between the corner columns 20. The upper handle portion 40 is spaced above the lower handle portion 42 to provide a handle opening. The end columns 22 extend upward from the base 12 to the lower handle portion 42.

Each of the side columns 18 includes a lower column portion 44 and an upper column portion 45. The lower column portion 44 is below the side band 24. The upper column portion 45 is formed on the interior of the side band 24. The lower column portion 44 includes a pair of angled, concave lower side walls joined by a front wall. The upper column portion 45 includes a pair of angled, concave upper side walls joined by an upper front wall. The upper side walls are recessed (i.e., offset outward of the crate 10) relative to the lower side walls. A vertical interior rib 54 extends generally perpendicularly between the side band 24 and the upper front wall of each upper column portion 45.

A plurality of low profile dividers 62 extend upward from the base 12 between the circular platforms, thereby partially defining bottle receiving pockets.

Figure 2:
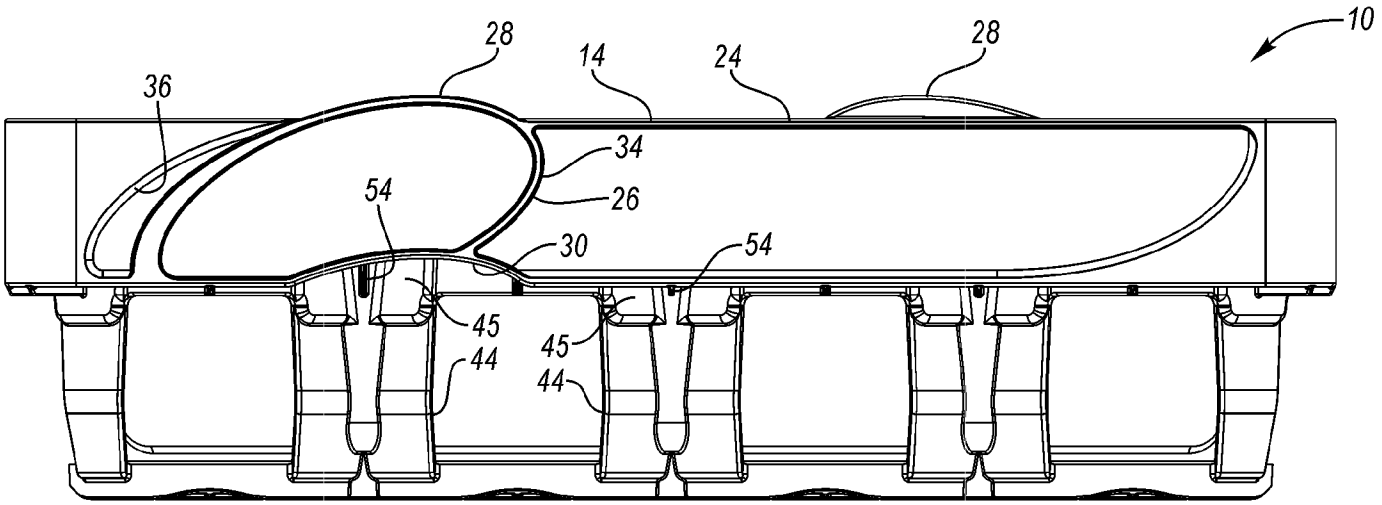
FIG. 2 is a side view of the crate of FIG. 1.

FIG. 2 is a side view of the crate 10. As shown, the curved protruding portions 28 of the side band 24 are the highest points on the crate 10.

Figure 3:
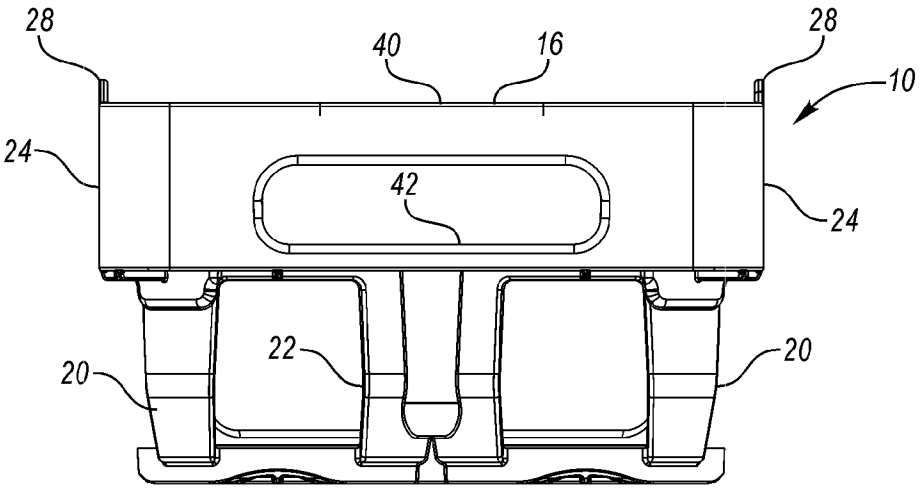
FIG. 3 is an end view of the crate of FIG. 1.
Figure 4:
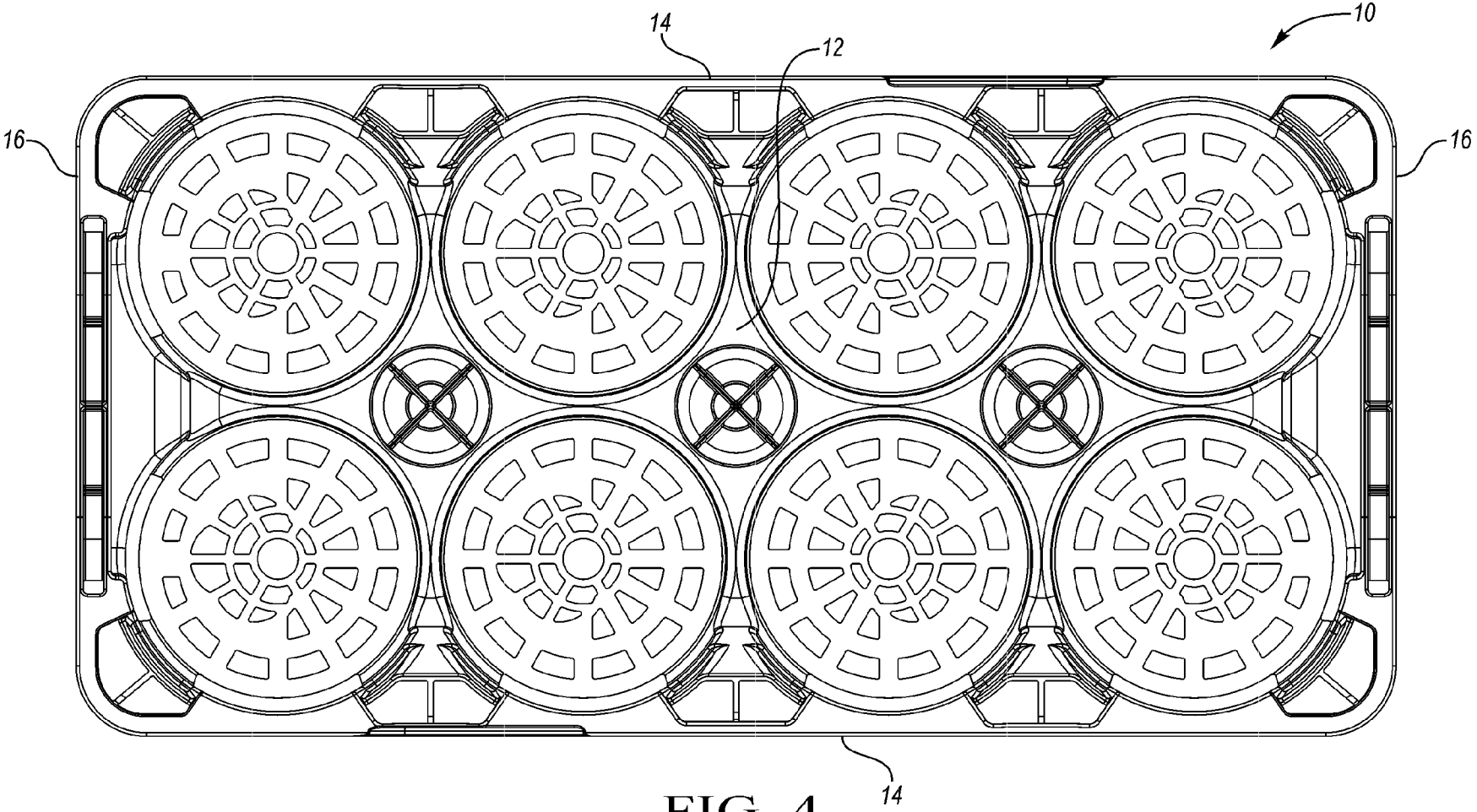
FIG. 4 is a top view of the crate of FIG. 1.
Figure 5:
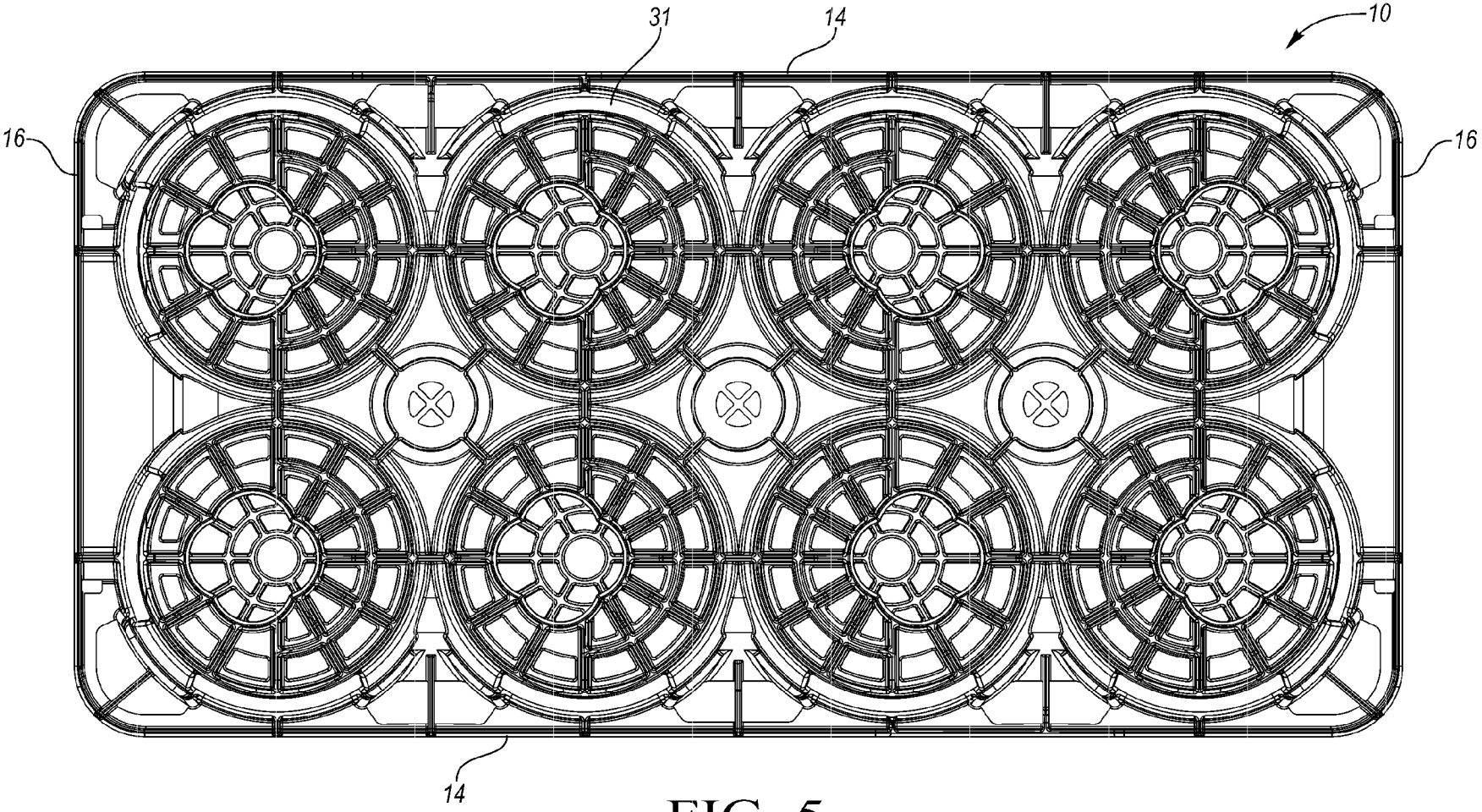
FIG. 5 is a bottom view of the crate of FIG. 1.

FIG. 3 is an end view of the crate 10. FIG. 4 is a top view of the crate 10. FIG. 5 is a bottom view of the crate 10.

Figure 6:
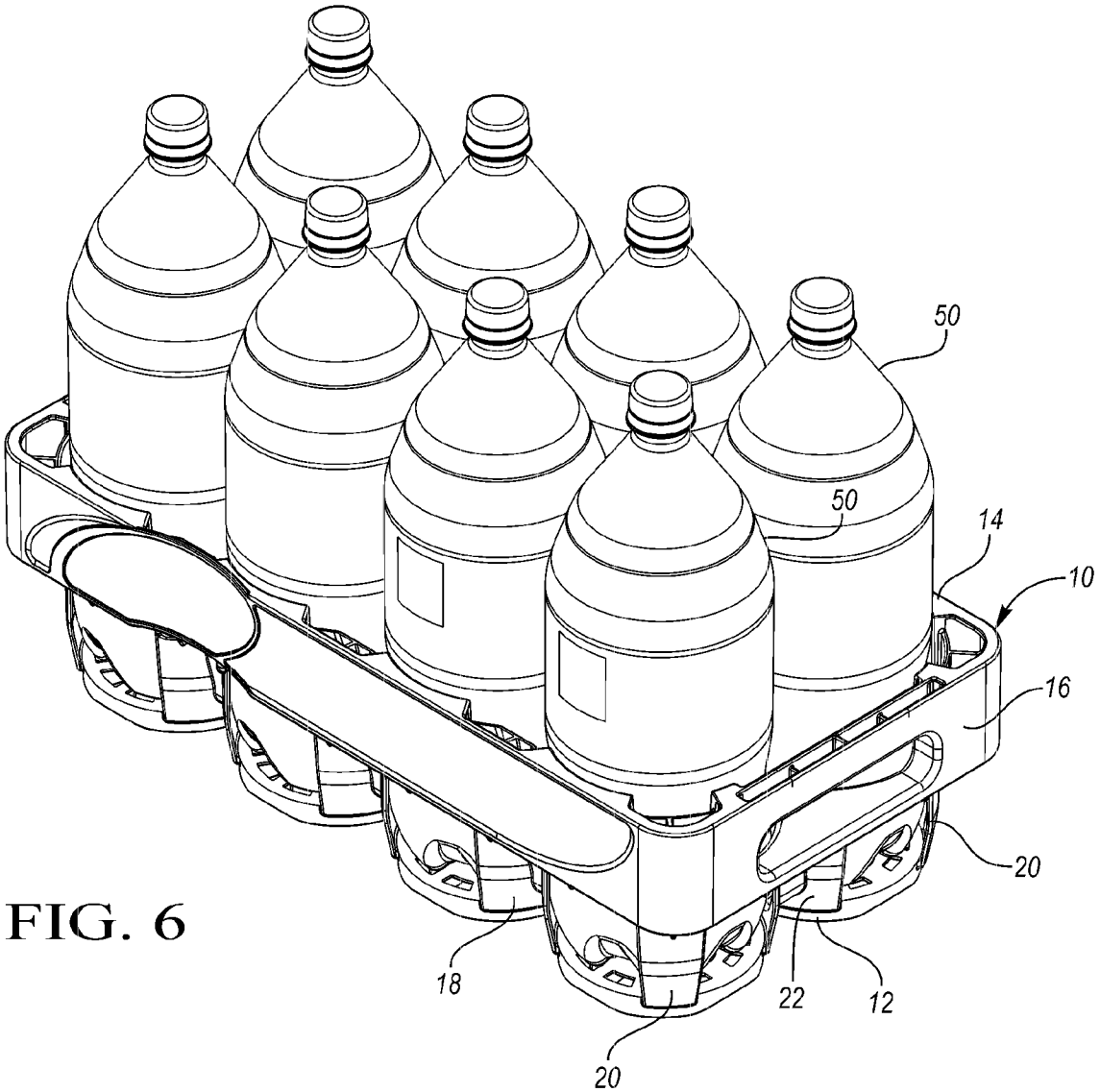
FIG. 6 is a perspective view of the crate of FIG. 1 with a plurality of bottles received therein.

FIG. 6 is a perspective view of the crate 10 with a plurality of bottles 50 (in this example, 2-liter bottles 50) received therein.

Figure 7:
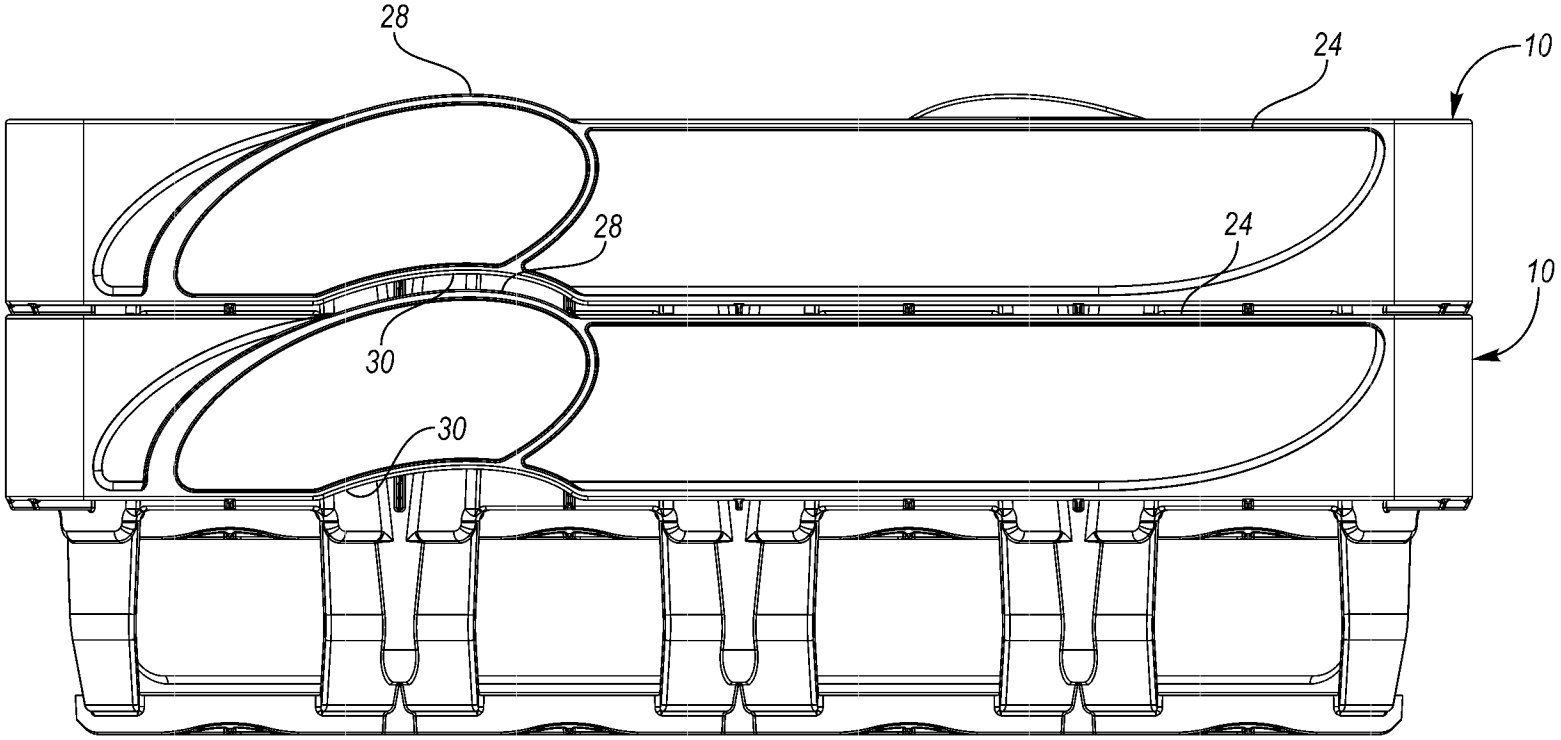
FIG. 7 is a side view of the crate of FIG. 1 with an identical crate nested therein.

In FIG. 7, the crate 10 is empty and is nested into an identical crate 10. When nested, the crates 10 occupy less volume for efficient storage and shipping for reuse. The curved protruding portion 28 of the logo portion 26 of the lower crate 10 is received in the curved cutout 30 in the side band 24 of the upper crate 10. In this manner, the curved protruding portions 28 do not increase the nested height of the crates 10.

Figure 8:
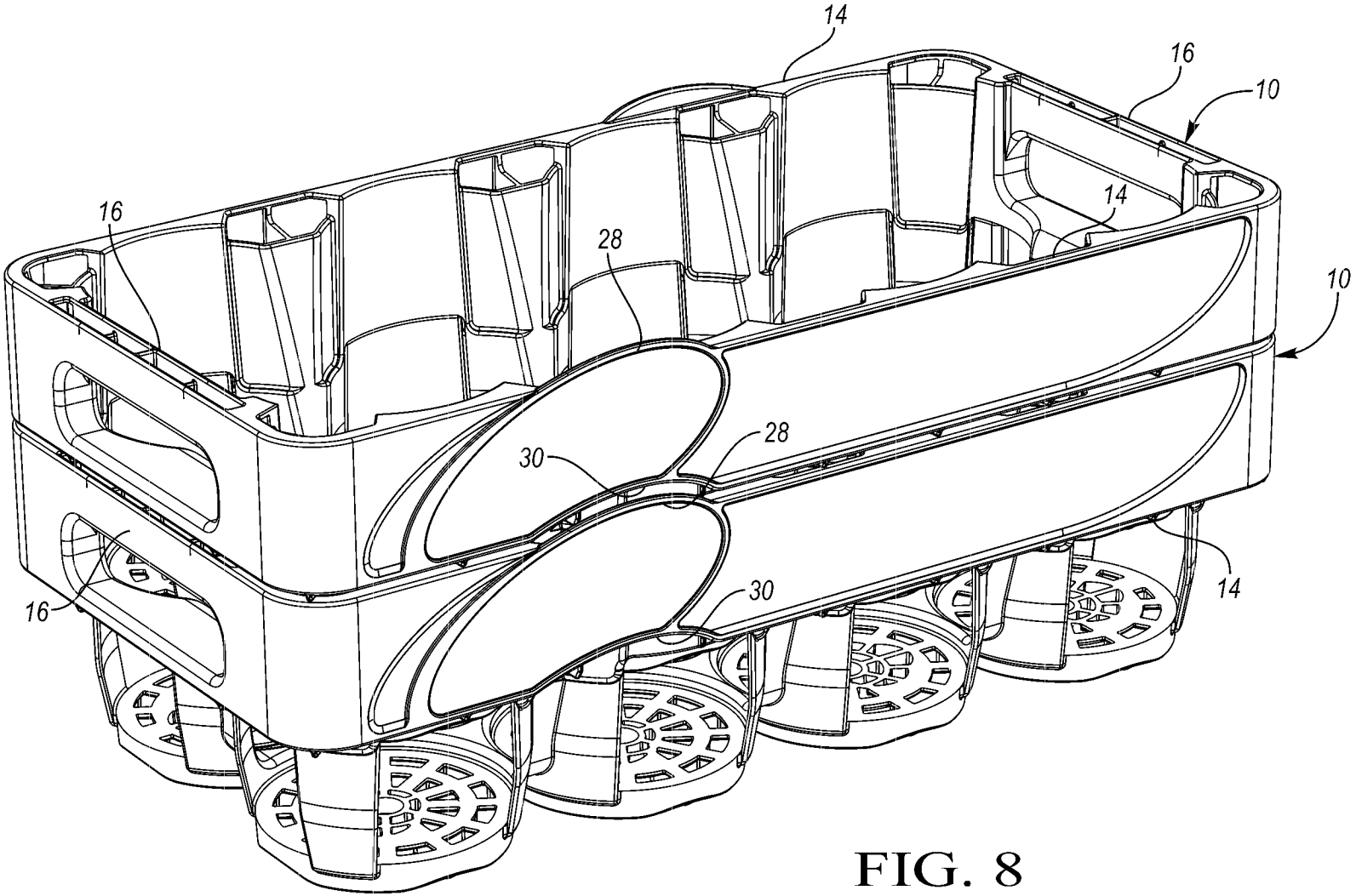
FIG. 8 is a perspective view of the crates of FIG. 7.
Figure 9:
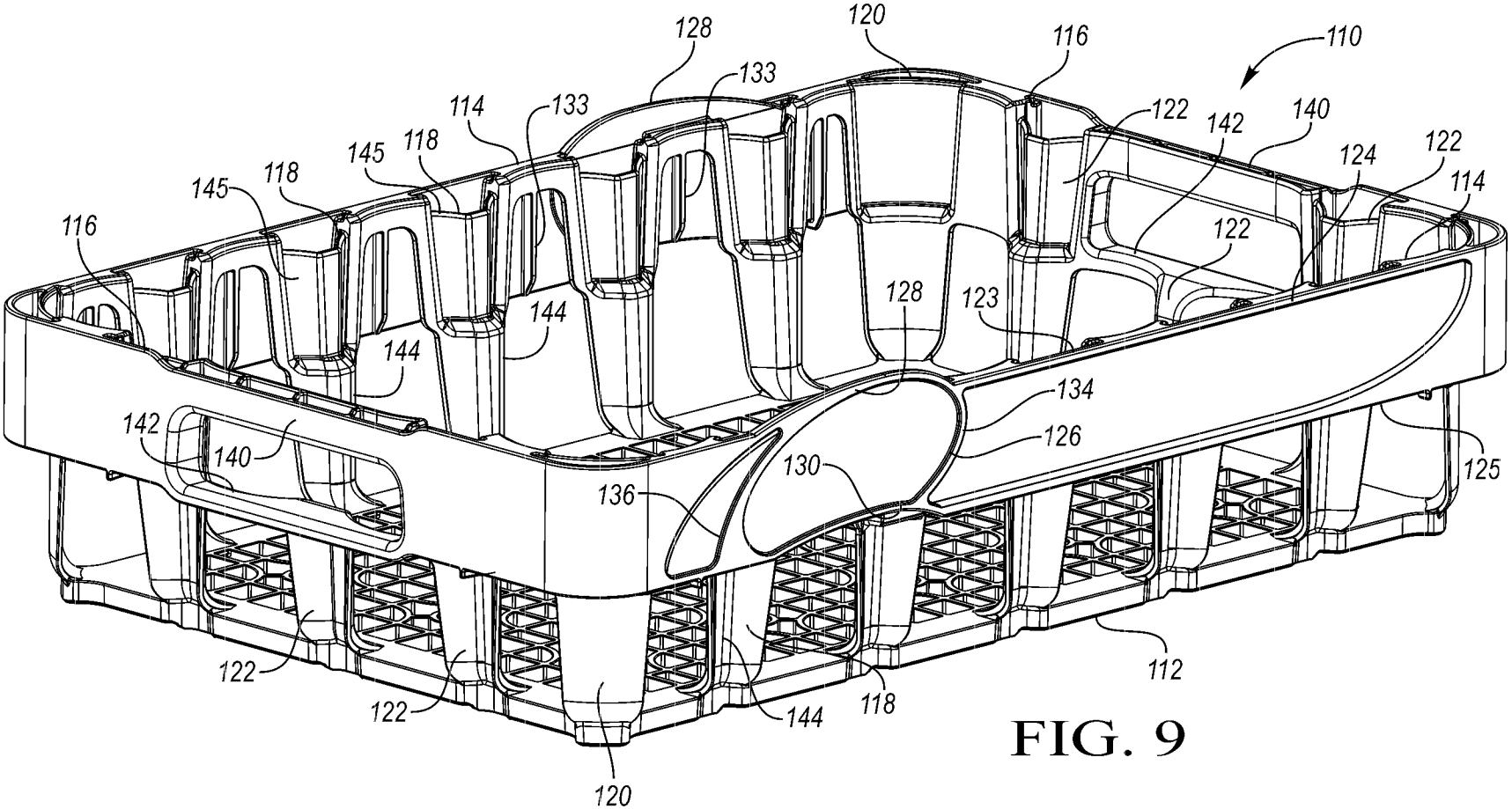
FIG. 9 is a perspective view of a crate according to another embodiment of the present invention.

FIG. 8 is a perspective view of the nested crates 10 of FIG. 7.

A crate 110 according to a second embodiment of the present invention is shown in FIGS. 9-15 and is particularly suited for single-serving bottles. The crate 110 includes a base 112, which is generally a flat lattice of ribs. A pair of side walls 114 extend upward from side edges of the base 112. End walls 116 extend upward from end edges of the base 112. Each side wall 114 includes a plurality of side columns 118 extending upward from the base 112. Corner columns 120 extend upward from corners of the base, while end columns 122 extend upward from ends of the base 112.

Each side wall 114 includes a side band 124 spaced upwardly from the base 112 and positioned along the outside of the side columns 118. The side band 124 generally includes a straight upper edge 123 and a straight lower edge 125, but also includes a logo portion 126, which in this embodiment is in the form of an ellipse or oval whose major axis is at an acute, non-zero angle relative to the straight upper edge 123. The logo portion 126 is superimposed over the straight upper edge 123 of the side band 124 and includes a curved protruding portion 128 that protrudes upward relative to the otherwise straight upper edge 123 of the side band 124. At a lower end, the logo portion 126 is truncated by the straight lower edge 125 and a curved cutout 130 in the otherwise straight lower edge 125 of the side band 124. The logo portion 126 is completely circumscribed by a rib 134. The side band 124 further includes a recessed arcuate portion 136 adjacent the logo portion 126. Between the columns 118, the side wall 114 includes at least one vertical rib 133 extending inward from the side band 124.

The logo portions 126 on the two side bands 124 are off-center and are on opposite ends of the centerline. This arrangement of the curved protruding portions 128 provides a relatively unstable surface for the crate 110 if the crate 110 were flipped over. This discourages theft of the crate 110, because it cannot be used as a stool, step or other support surface.

Each end wall 116 includes an upper handle portion 140 and a lower handle portion 142 extending between the corner columns 120. The upper handle portion 140 is spaced above the lower handle portion 142 to provide a handle opening. The end columns 122 extend upward from the base 112. A center end column 122 extends upward only to the lower handle portion 142.

Each of the side columns 118 includes a lower column portion 144 and an upper column portion 145. The lower column portion 144 is below the side band 124. The upper column portion 145 is formed on the interior of the side band 124. The lower column portion 144 includes a pair of angled, concave lower side walls joined by a front wall. The upper column portion 145 includes a pair of angled, concave upper side walls joined by an upper front wall. The upper side walls are recessed (i.e., offset outward of the crate 110) relative to the lower side walls.

Figure 10:
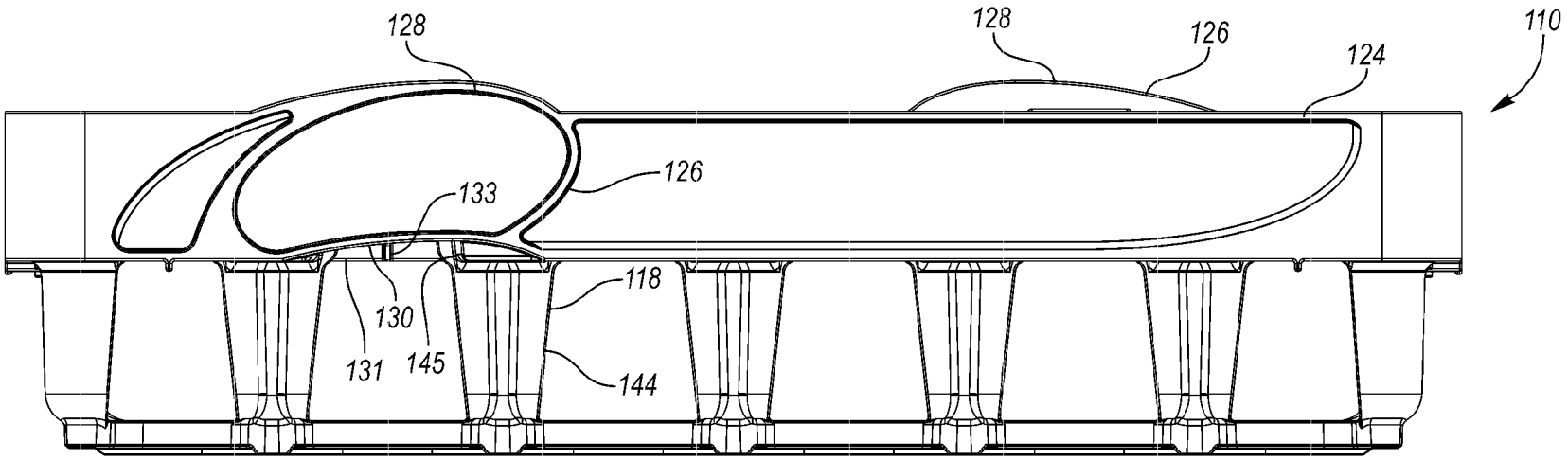
FIG. 10 is a side view of the crate of FIG. 9.

FIG. 10 is a side view of the crate 110. As shown, the curved protruding portions 128 of the side band 124 are the highest points on the crate 110.

Figure 11:
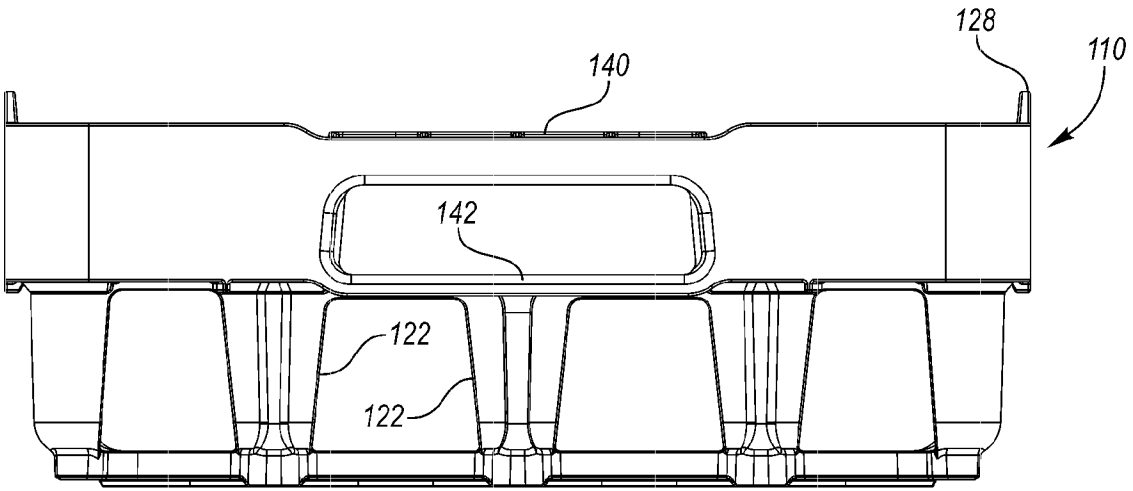
FIG. 11 is an end view of the crate of FIG. 9.
Figure 12:
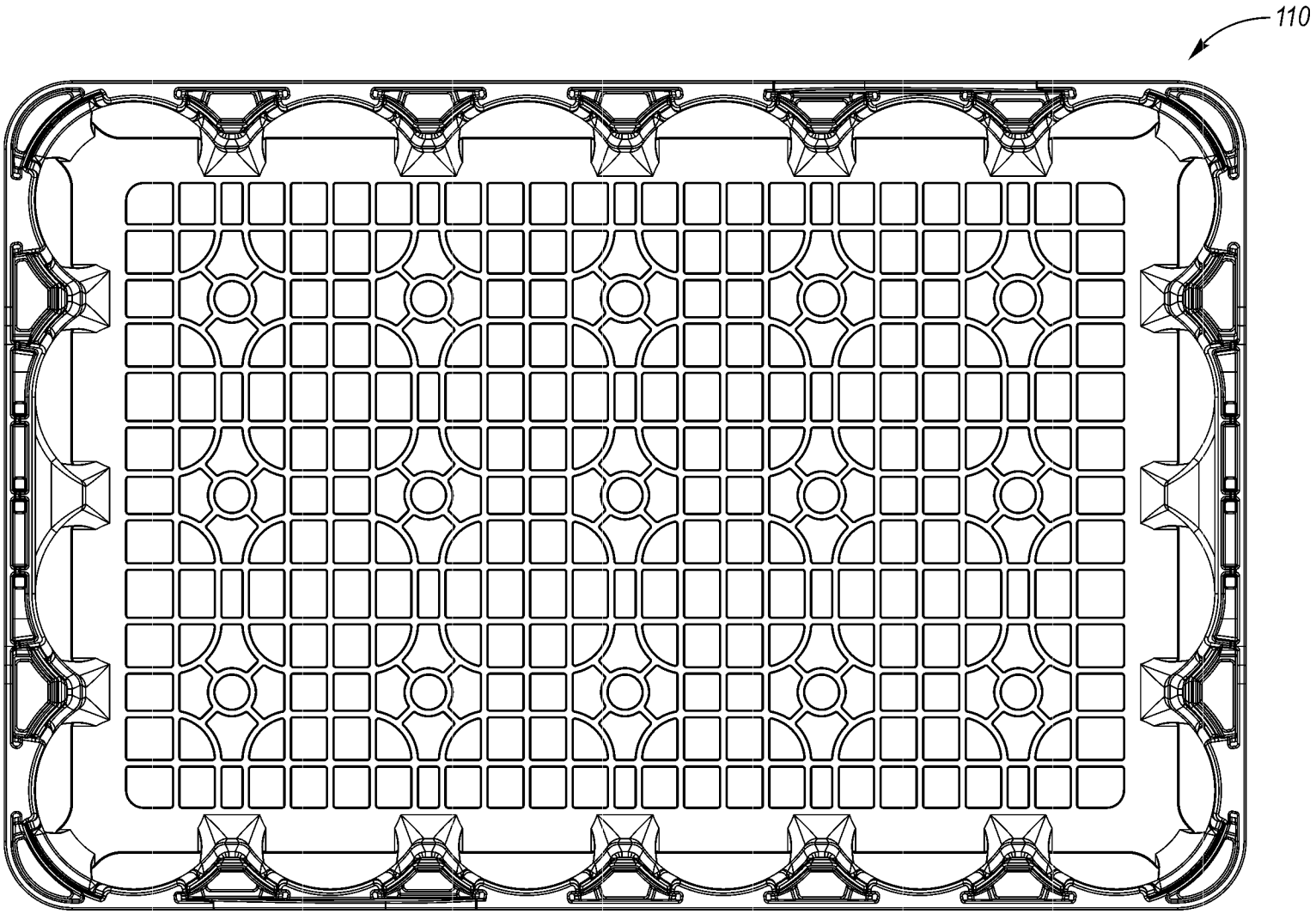
FIG. 12 is a top view of the crate of FIG. 9.
Figure 13:
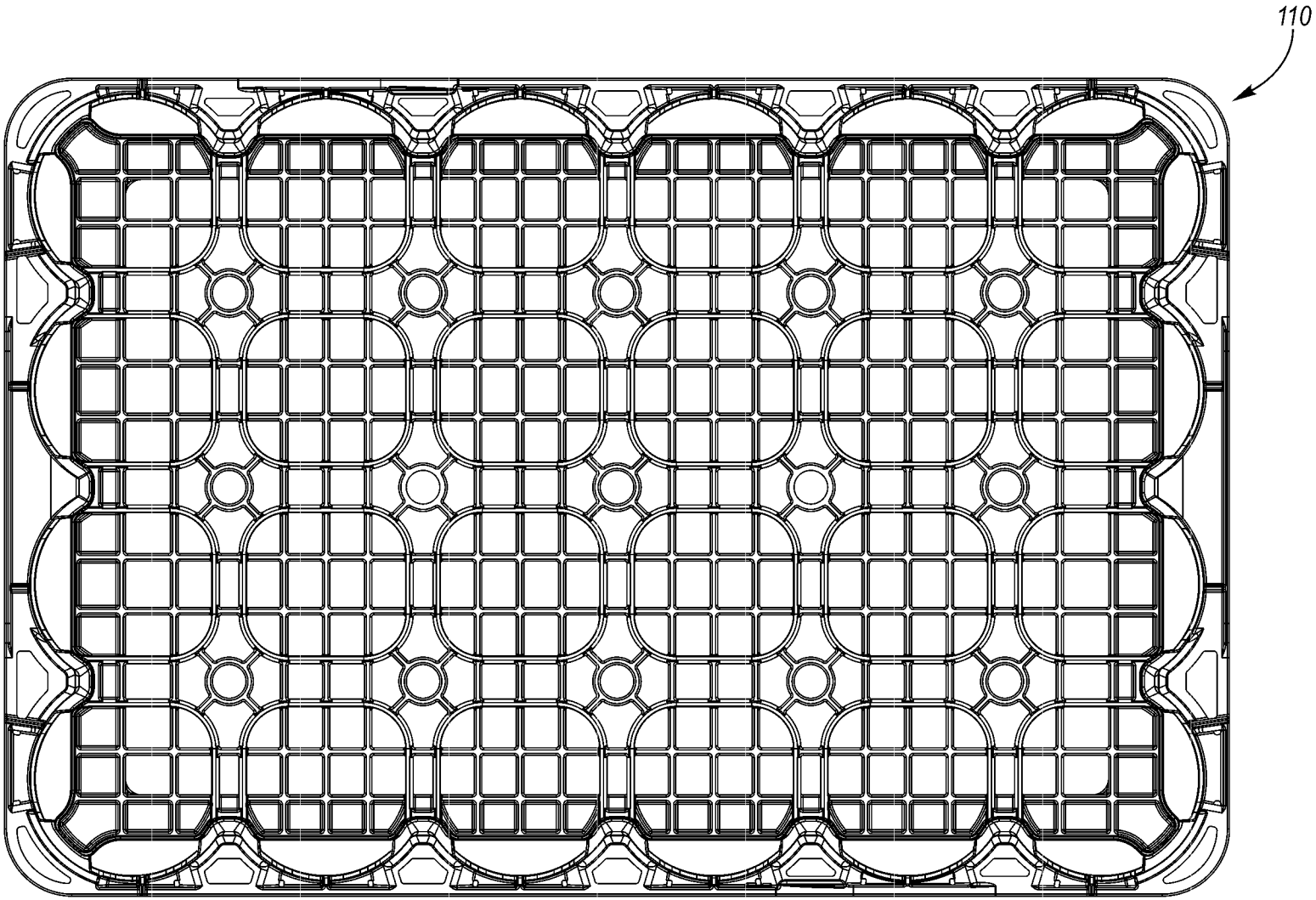
FIG. 13 is a bottom view of the crate of FIG. 9.

FIG. 11 is an end view of the crate 110. FIG. 12 is a top view of the crate 110. FIG. 13 is a bottom view of the crate 110.

Figure 14:
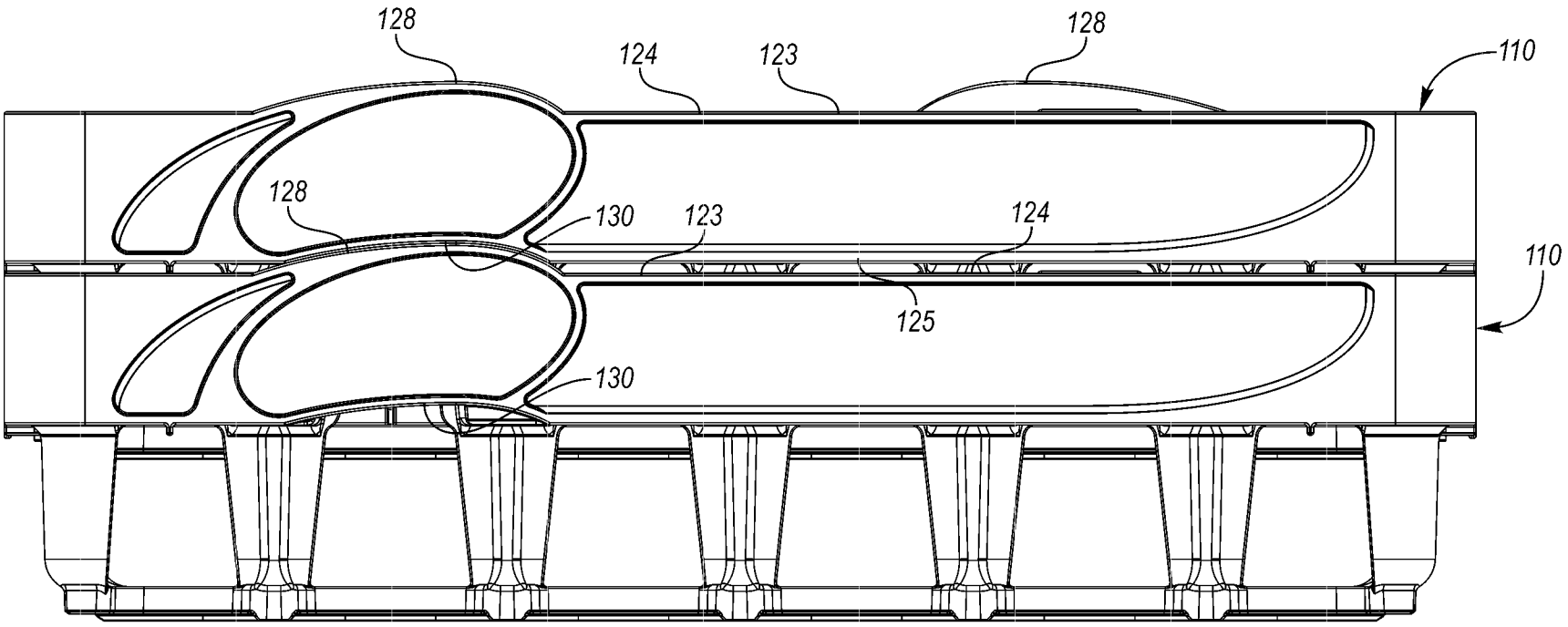
FIG. 14 is a side view of the crate of FIG. 9 with an identical crate nested therein.

In FIG. 14, the crate 110 is empty and is nested into an identical crate 110. When nested, the crates 110 occupy less volume for efficient storage and shipping for reuse. The curved protruding portion 128 of the logo portion 126 of the lower crate 110 is received in the curved cutout 130 in the side band 124 of the upper crate 110. In this manner, the curved protruding portions 128 do not increase the nested height of the crates 110.

Figure 15:
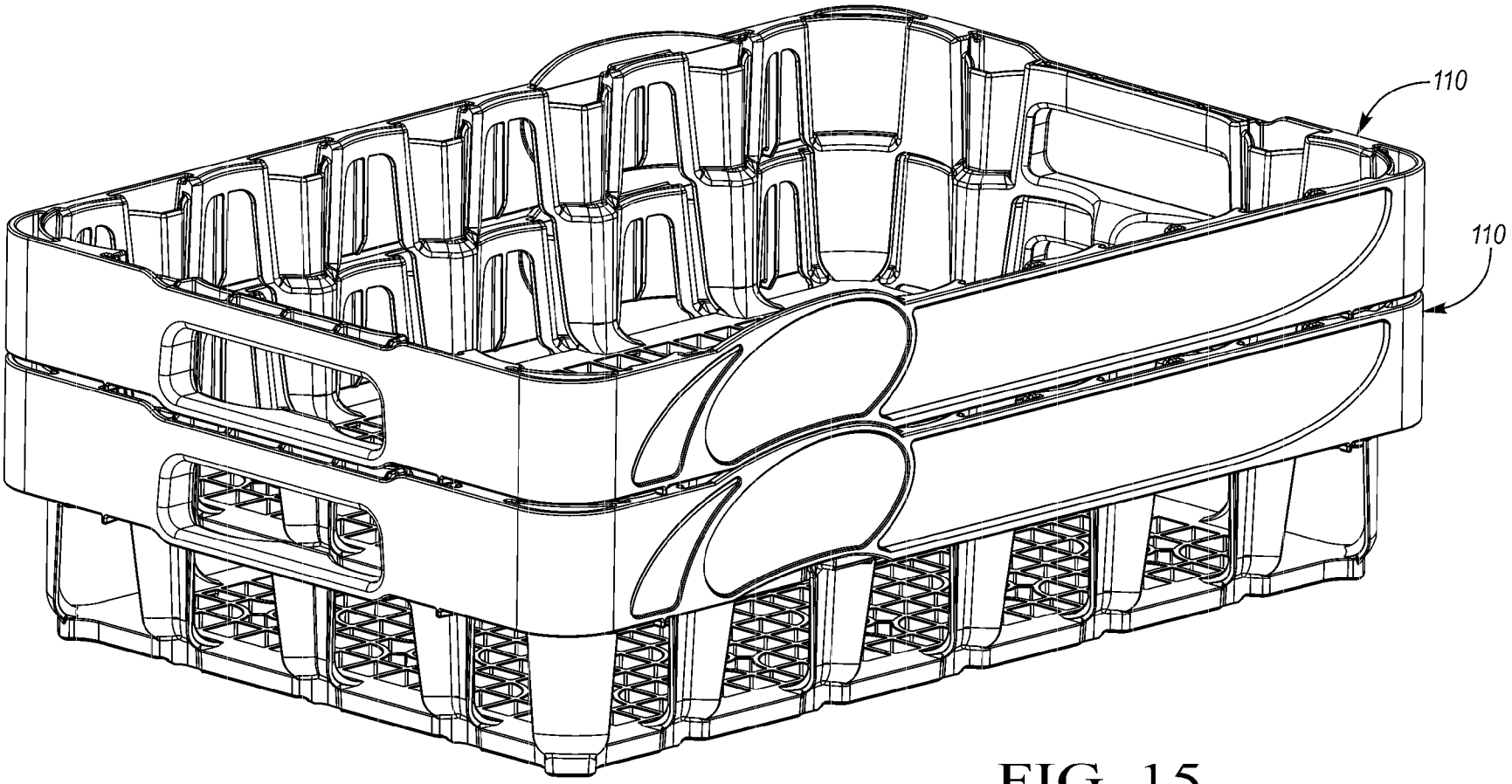
FIG. 15 is a perspective view of the crates of FIG. 14.

FIG. 15 is a perspective view of the nested crates 110 of FIG. 12.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A crate comprising:

a base;

a pair of opposed end walls extending upward from the base;

a side wall extending upward from the base between the end walls, the side wall including a plurality of side columns extending upward from the base to a side band, the side band including a logo portion having a protruding portion protruding upward relative to an upper edge of the side band, the side band further including a curved recess formed in a lower edge of the side band, the curved recess complementary to the protruding portion of the logo portion, such that when an identical crate is nested in the crate, the protruding portion of the crate is received in the curved recess of the identical crate.

2. The crate of claim 1 wherein the protruding portion of the logo portion is offset from a center of the side band.

3. The crate of claim 1 wherein the logo portion is circumscribed by a rib.

4. The crate of claim 1 further including a recessed arcuate portion adjacent the logo portion.

5. The crate of claim 1 wherein the logo portion is generally an ellipse truncated by the curved recess and by the lower edge of the side band, wherein the lower edge of the side band is generally straight other than the curved recess.

6. The crate of claim 1 wherein the upper edge of the side band is generally straight except for the protruding portion.

7. The crate of claim 1 wherein the protruding portion is an uppermost edge of the crate.

8. The crate of claim 1 wherein the side wall is a first side wall, the crate further including a second side wall opposite the first side wall and connecting the end walls, the second side wall including the recited elements of the first side wall.

9. The crate of claim 1 wherein the base includes a plurality of dividers.

10. The crate of claim 9 wherein the plurality of dividers are low-profile.

11. The crate of claim 1 wherein the protruding portion is off-center of the logo portion.

12. A crate comprising:

a base;

a pair of opposed end walls extending upward from the base;

a pair of opposed side walls extending upward from the base between the end walls, each side wall including a plurality of side columns extending upward from the base to a side band, each side band including a logo portion having a protruding portion protruding upward relative to an upper edge of the side band, each side band further including a curved recess formed in a lower edge of the side band, the curved recess complementary to the protruding portion of the logo portion, wherein the protruding portions of the logo portions are offset in opposite directions from a center of the side walls.

* * * * *

UNITED STATES PATENT AND TRADEMARK OFFICE

CERTIFICATE OF CORRECTION

PATENT NO. : 8,960,479 B2
APPLICATION NO. : 14/054025
DATED : February 24, 2015
INVENTOR(S) : Ryan C. Meers It is certified that error appears in the above-identified patent and that said Letters Patent is hereby corrected as shown below:

ON THE TITLE PAGE:

Item (73) Assignee should read as follows:

--Rehrig Pacific Company, Los Angeles, CA (US)--

Signed and Sealed this
Twenty-sixth Day of May, 2015

Michelle K. Lee

Michelle K. Lee
*Director of the United States Patent and Trademark Office*